US009546539B2

(12) United States Patent
Hudson et al.

(10) Patent No.: US 9,546,539 B2
(45) Date of Patent: Jan. 17, 2017

(54) DOWNHOLE POWER GENERATION

(75) Inventors: Steven Martin Hudson, Dorset (GB); Alexandra Vasil'evna Rogacheva, Southampton (GB)

(73) Assignee: Expro North Sea Limited, Aberdeen (GB)

( * ) Notice: Subject to any disclaimer, the term of this patent is extended or adjusted under 35 U.S.C. 154(b) by 1492 days.

(21) Appl. No.: 13/000,867

(22) PCT Filed: Jun. 25, 2009

(86) PCT No.: PCT/GB2009/001597
§ 371 (c)(1),
(2), (4) Date: Mar. 2, 2011

(87) PCT Pub. No.: WO2009/156734
PCT Pub. Date: Dec. 30, 2009

(65) Prior Publication Data

US 2011/0148656 A1 Jun. 23, 2011

(30) Foreign Application Priority Data

Jun. 25, 2008 (GB) ..... 0811663.4

(51) Int. Cl.

| | |
|---|---|
| ***H04B 13/02*** | (2006.01) |
| ***G01V 3/00*** | (2006.01) |
| ***F16D 31/00*** | (2006.01) |
| ***F16D 33/00*** | (2006.01) |
| ***F16D 33/02*** | (2006.01) |
| ***F16D 31/02*** | (2006.01) |

(Continued)

(52) U.S. Cl.
CPC ..... *E21B 41/0085* (2013.01)

(58) Field of Classification Search
CPC ..... E21B 41/0085; E21B 4/04; E21B 21/10; E21B 43/103; E21B 47/122; G01V 11/002; G08B 15/004; G08B 25/016
USPC ..... 340/850–856.4; 290/54
See application file for complete search history.

(56) References Cited

U.S. PATENT DOCUMENTS 4,532,614 A * 7/1985 Peppers ..... 367/81
4,654,537 A * 3/1987 Gaspard ..... F03B 13/00 290/54

(Continued)

FOREIGN PATENT DOCUMENTS

AU 2000053538 A1 * 11/2000 ..... E21B 41/00
WO WO 2008/070509 A2 6/2008
WO WO 2008/070509 A3 6/2008

OTHER PUBLICATIONS

Author/Title: http://dictionary.reference.com/browse/Telemetry; Captured Date: Jun. 2, 2014.*

(Continued)

*Primary Examiner* — Steven Lim
*Assistant Examiner* — Muhammad Adnan

(57) ABSTRACT

Downhole electrical power generation apparatus and methods of using stored pressurized gas and/or ambient downhole pressure. One example comprises first and second fluid receiving chambers, a fluid communication path for allowing flow of fluid from the first chamber via the fluid communication path to the second chamber and a turbine generator disposed so that fluid flowing from the first chamber via the fluid communications path to the second chamber operates the turbine generator to generate electrical power.

29 Claims, 4 Drawing Sheets

Figure 1:
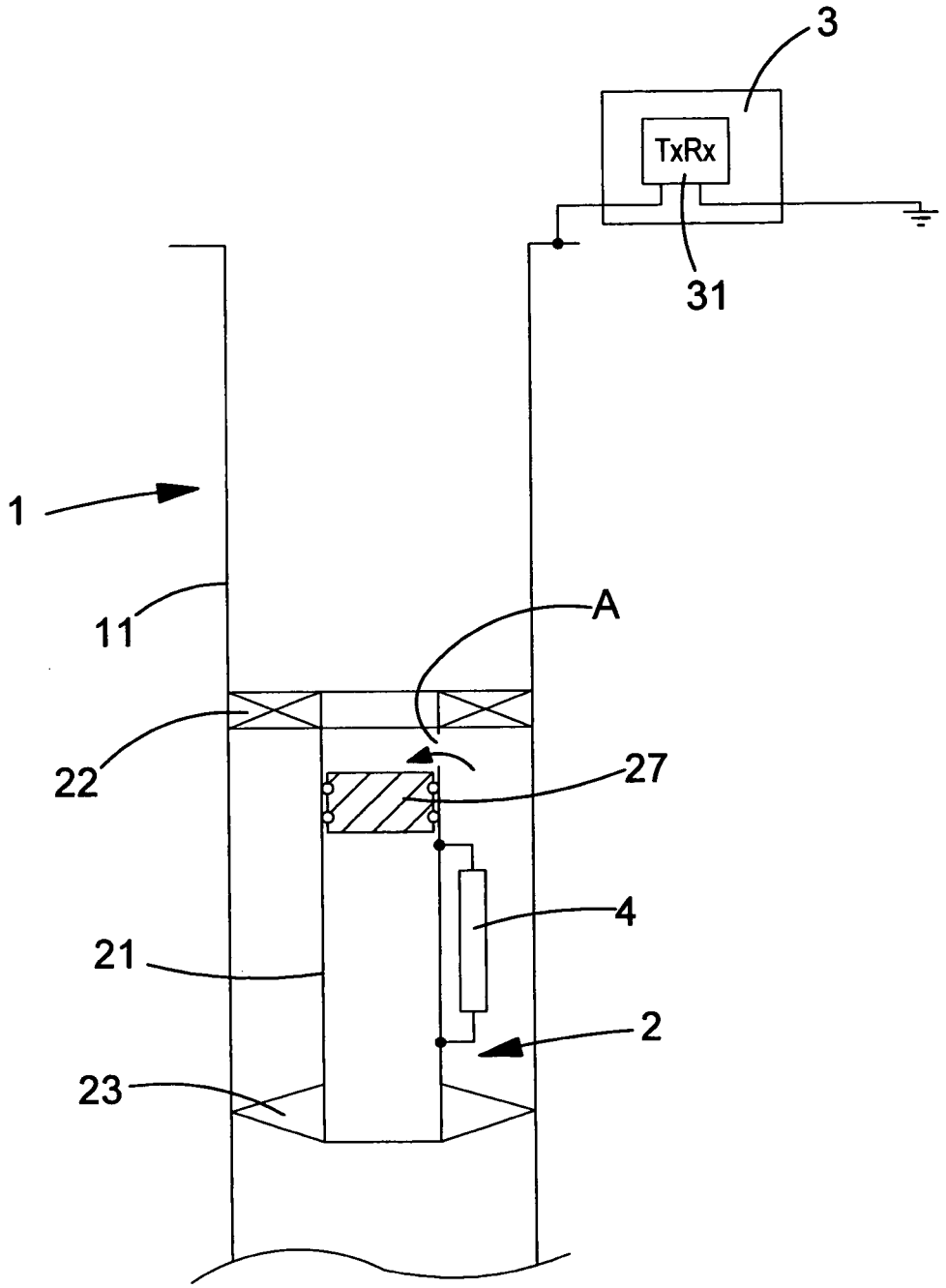

(51) Int. Cl.
*F16D 39/00* (2006.01)
*E21B 41/00* (2006.01)

(56) References Cited

U.S. PATENT DOCUMENTS 4,796,699 A * 1/1989 Upchurch ..... E21B 23/04 166/250.17
4,972,149 A * 11/1990 Cox et al. ..... 324/339
5,050,681 A * 9/1991 Skinner ..... E21B 34/066 166/319
5,149,984 A * 9/1992 Schultz et al. ..... 290/54
5,839,508 A * 11/1998 Tubel ..... G01V 1/42 166/65.1
6,717,283 B2 * 4/2004 Skinner et al. ..... 290/43
6,868,906 B1 * 3/2005 Vail et al. ..... 166/250.01
7,002,261 B2 * 2/2006 Cousins ..... 290/54
7,347,283 B1 * 3/2008 Sharp et al. ..... 175/61
7,388,382 B2 * 6/2008 Strack et al. ..... 324/368
7,696,632 B1 * 4/2010 Fuller ..... 290/54
8,416,098 B2 * 4/2013 Garcia-Osuna et al. .. 340/854.4
2003/0085036 A1 * 5/2003 Curtis ..... E21B 21/065 166/267
2003/0116969 A1 6/2003 Skinner et al.
2005/0200210 A1 9/2005 Kotsonis et al.
2005/0207279 A1 9/2005 Chemali et al.
2006/0175838 A1 * 8/2006 Tips ..... E21B 41/0085 290/1 R
2008/0128123 A1 6/2008 Gold
2012/0313790 A1 * 12/2012 Heijnen et al. ..... 340/854.6

OTHER PUBLICATIONS

International Search Report and Written Opinion of corresponding PCT International Application No. PCT/GB2009/00597 dated Nov. 4, 2009.
UK Search Report for corresponding GB Application No. 0811663.4 dated Jul. 20, 2008.

* cited by examiner

DOWNHOLE POWER GENERATION

CROSS REFERENCE TO RELATED APPLICATIONS

This application is a national stage of PCT International Application No. PCT/GB2009/001597, filed on Jun. 25, 2009, and published in English on Dec. 30, 2009,as WO 2009/156734 A1, and which claims priority to GB 0811663.4 filed on Jun. 25, 2008, the entire disclosures of which are incorporated herein by reference.

This invention relates to downhole electrical power generation.

There are a number of situations where it is desirable to have equipment downhole in an oil or gas well which requires power to operate. In many circumstances electrical power is necessary or preferred. Thus, for example, sensors are often provided downhole for measuring parameters such as pressure and/or temperature. The power requirements for such measurements may be low, but it can be a different matter when it comes to sending data relating to those measurements back to the surface.

One communication technique which is now used by the Applicants, amongst others, makes use of the metallic structure of the well itself, that is to say the metallic tubing provided in the well, (e.g. casing, liner or production tubing), as a signal channel for carrying electrical signals between the surface and the downhole location. Such signalling can be made to work well using very low frequency and very high current signals. Often the data rates achievable are not particularly high, but this does not matter where relatively little data needs to be transmitted—for example, pressure readings taken say, once a day or even less frequently. However, because of losses, the power required to transmit the data can be high and this can lead to a large quantity of expensive batteries being required to transmit many readings from a downhole tool. Furthermore, there is a problem in that batteries tend to self-discharge, particularly in the high temperatures which are normal downhole. Thus, even when readings are not being transmitted to the surface, power from the batteries can be lost just as time elapses.

Thus, it is an aim of the present invention to provide an alternative downhole power source.

According to one aspect of the present invention there is provided downhole electrical power generation apparatus comprising first and second fluid receiving chambers, a fluid communication path for allowing flow of fluid from the first chamber via the fluid communication path to the second chamber and a turbine generator disposed so that fluid flowing from the first chamber via the fluid communication path to the second chamber operates the turbine generator to generate electrical power.

The second chamber may be sealed against the ingress of fluid except for fluid received from the first chamber. The second chamber may be sealed against the ingress of fluid except via the fluid communication path from the first chamber.

The first chamber may be sealed against the egress of fluid except for fluid supplied towards the second chamber. The first chamber may be sealed against the egress of fluid except via the fluid communication path to the second chamber.

The first chamber may be arranged to receive a liquid. The second chamber may be arranged to receive a gas. The first chamber may hold a liquid, for example oil or water. The second chamber may hold a gas, for example air.

The power generation apparatus may comprise a piston which is moveable to reduce the volume of the first chamber for driving fluid from the first chamber into the second chamber.

The piston may be moveable under action of ambient pressure.

The power generation apparatus may comprise pressure transfer means for transferring ambient pressure in the region in which the apparatus is disposed to fluid held in the first fluid receiving portion.

The power generation apparatus may comprise a portion of tubing which partly defines the first chamber and the second chamber. The portion of tubing may have a blanked end which defines one end of the second chamber. The piston may be provided in and seal with the tubing to define one end of the first chamber. The piston may be arranged to slide axially relative to the tubing to alter the volume of the first chamber.

The power generation apparatus may comprise a third fluid receiving chamber, which may be arranged to be pressurised using ambient pressure. The third chamber may be arranged to store a pressurised gas.

The third fluid receiving chamber may be arranged to be charged with gas present in the well and hence pressurised. This may be gas "product" allowed into the chamber when the apparatus is downhole.

In an alternative the third fluid receiving chamber may be arranged to be pressurised at or near the surface. A source of gas may be provided into the well to charge the third chamber whilst the apparatus is in a well but before the apparatus is disposed in its intended downhole location.

The third chamber may hold a gas, for example air. This gas may be pressurised under action of ambient pressure once the apparatus is downhole—the apparatus may be arranged to allow this.

The power generation apparatus may comprise a second piston which is moveable under action of ambient pressure to reduce the volume of the third fluid receiving chamber. The chambers and pistons may be arranged with the second piston exposed to ambient pressure and being disposed at one end of the third chamber, the first piston disposed between the third chamber and the first chamber, and the second chamber beyond the first chamber.

Where the power generation apparatus comprises a portion of tubing this may partly define the third chamber, with the second piston defining one end of the third chamber and the first piston defining the other end of the third chamber.

The second piston may be lockable against movement relative to a main body of the power generation apparatus. The second piston may be arranged for sliding axial movement relative to the tubing and may be lockable against such movement.

The power generation apparatus may comprise control means for controlling flow of fluid from the first chamber to the second chamber via the fluid communication path. The control means may comprise a valve.

The control means may be arranged to open the valve to allow flow of fluid via the fluid communication path to generate electricity when in receipt of a signal indicating that power is required and to hold the valve closed at other times.

Such a signal might be generated at predetermined times and/or under predetermined conditions.

According to another aspect of the present invention there is provided a downhole communication system comprising:

communication apparatus comprising at least one of a transmitter and a receiver; and downhole electrical power generation apparatus as defined above for supplying electrical power to the communication apparatus.

The communication apparatus may comprise a control unit which may be arranged to send a signal, indicating that power is required, to the downhole electrical power generation apparatus at predetermined times and/or under predetermined conditions.

The predetermined conditions may comprise the fact that signals are to be transmitted by the communications apparatus.

According to another aspect of the present invention there is provided a well installation comprising downhole metallic structure and, disposed within the metallic structure, downhole electrical power generation apparatus as defined above.

According to another aspect of the present invention there is provided a well installation comprising a downhole metallic structure and a downhole communication system as defined above.

The downhole metallic structure may be used as a signal channel by the downhole communication system.

According to a further aspect of the present invention there is provided a method of downhole electrical power generation comprising the steps of using ambient downhole pressure to cause flow of fluid from a first fluid receiving chamber via a fluid communication path to a second fluid receiving chamber and using the flow of fluid from the first chamber to the second camber to operate a turbine generator to generate electrical power.

The method may comprise the step of pressurizing a third fluid receiving chamber using ambient pressure and in turn using the pressure in the third fluid receiving chamber to cause the flow of fluid from the first fluid receiving chamber to the second fluid receiving chamber.

The step of pressurising the third chamber may be carried out once as an initialisation of step, and the using of the pressure to cause a flow of fluid from the first fluid receiving chamber to the second fluid receiving chamber may be carried out plural times, as power is required. This can minimise the disturbance to the intrinsic characteristics of the well in which the method is used.

According to a further aspect of the present invention there is provided a method of downhole electrical power generation comprising the steps of using energy stored in a stored pressurised gas to cause flow of fluid from a first fluid receiving chamber via a fluid communication path to a second fluid receiving chamber and using the flow of fluid from the first chamber to the second chamber to operate a turbine generator to generate electrical power.

The stored pressurised gas may be stored in a third fluid receiving chamber. The stored pressurised gas may be pressurised after storing using ambient downhole pressure. The stored pressurised gas may be pressurised before storage.

Clearly the optional features described with reference to any one of the above aspects of the invention may also be used with any of the other aspects of the invention, where context allows. Thus for example the optional apparatus features are equally pertinent to the above defined methods, and could be restated here with the necessary changes in language but are omitted for the sake of brevity.

Figure 2:
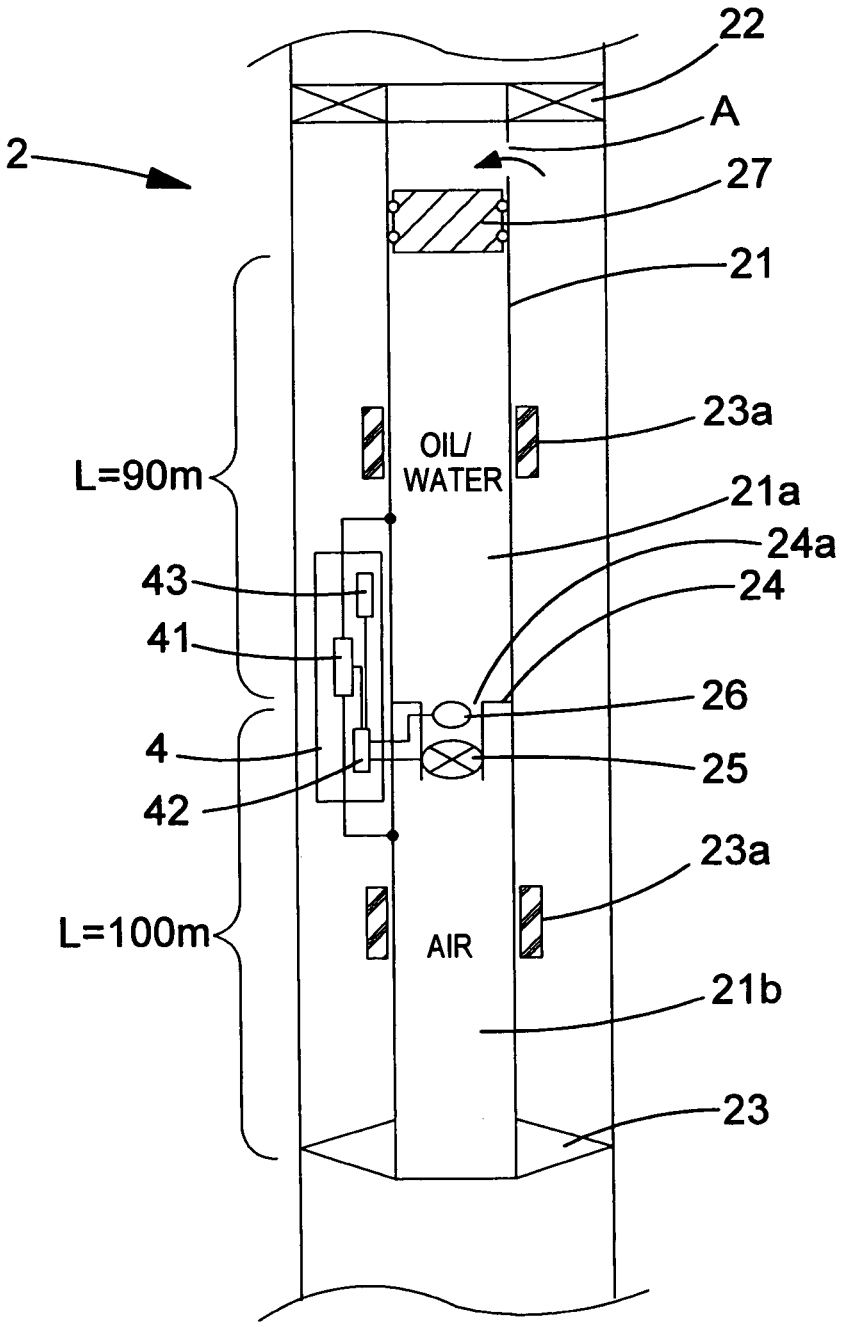
Figure 3:
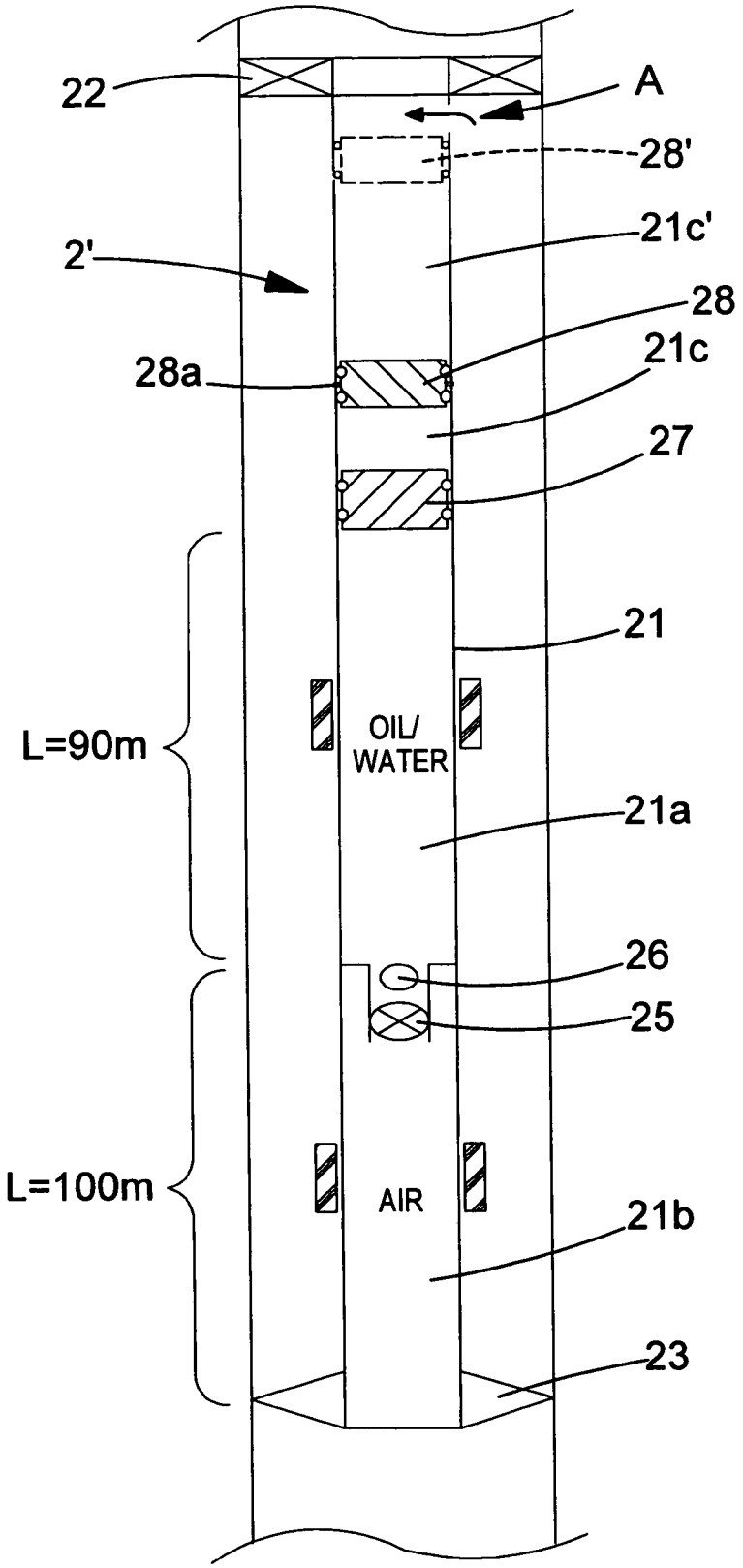
Figure 4:
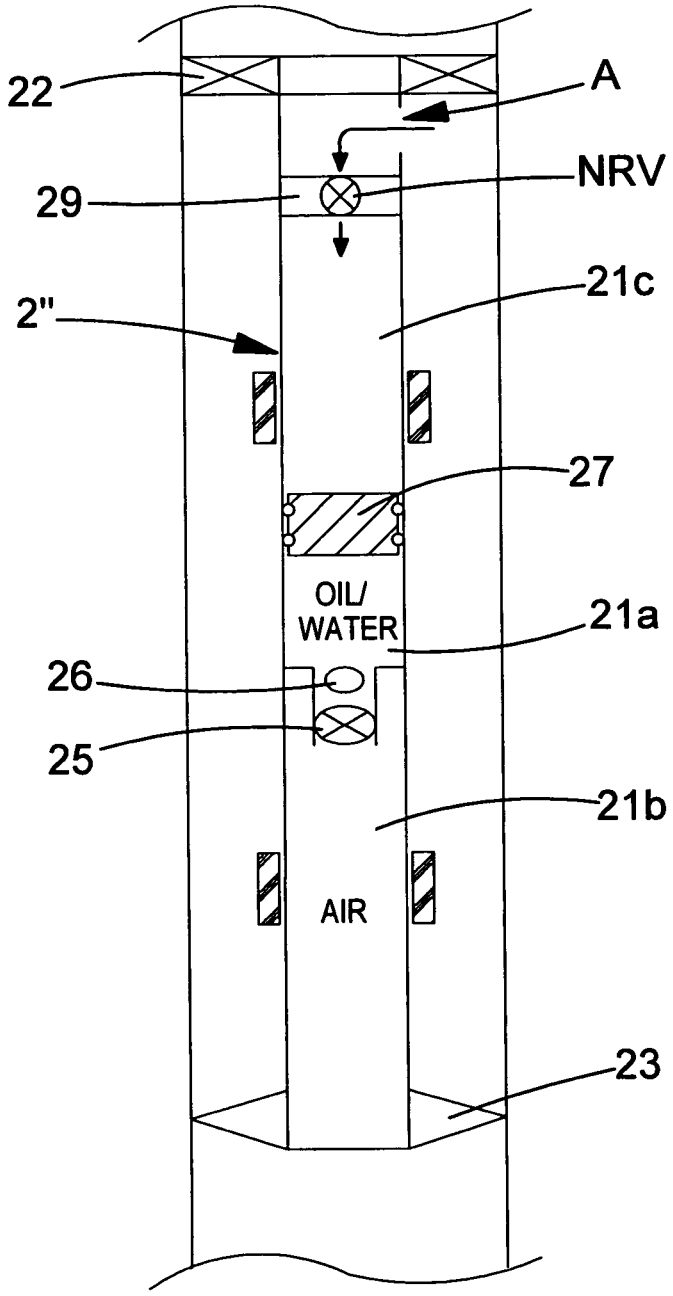

Embodiments of the present invention will now be described, by way of example only, with reference to the accompanying drawings in which:

FIG. 1 schematically shows a well installation including a downhole communication system which in turn includes a downhole electrical power generation apparatus;

FIG. 2 shows more detail of some of the downhole components of the well installation shown in FIG. 1;

FIG. 3 schematically shows part of an alternative downhole tool which is similar to a downhole tool shown in FIG. 2; and FIG. 4 schematically shows part of a second alternative downhole tool which is similar to the alternative downhole tool shown in FIG. 3.

FIGS. 1 and 2 schematically show a well installation comprising downhole metallic structure 1 in the form of a tubular metallic casing 11 and including a downhole communication system. A downhole tool 2 is disposed within the casing 11 and arranged for communicating with a surface unit 3.

In this embodiment the downhole tool 2 comprises a length of drill stem/production tubing 21 which is sealed at both ends and is supported within the casing 11 by a packer 22 at an upper end and a conductive centraliser 23 at a lower end. As alluded to above, such tubing 21 is typically used in the oil and gas industry as part of a drill stem when drilling a well or part of production tubing when extracting product from a well. Similarly, packers 22 and conductive centralisers 23 are used in such circumstances. Here, however, these components are used as part of the downhole tool 2. The packer 22 and conductive centraliser 23 ensure that there is good electrical contact between the tubing 21 and the casing 11 at spaced locations, i.e. at each end of the length of tubing 21.

The downhole tool 2 is shown in more detail in FIG. 2. The downhole tool 2 comprises a communications and control unit 4 which comprises a transceiver module 41, a control module 42 and a sensor module 43. The control module 42 controls operation of the transceiver module 41 in sending signals concerning local parameters detected by the sensor module 43 such as pressure. The transceiver module 41 is electrically connected to the piece of tubing 21 for the application of signals onto the tubing 21 and the extraction of signals form the tubing 21.

The surface unit 3 similarly comprises a transceiver module 31 which has one terminal connected to the downhole metallic structure, i.e. to the casing 11 and another terminal connected to ground. The transceiver modules 41, 31 are arranged to communicate with one another by sending low frequency and high current electrical signals via the metallic structure, in particular the casing 11, of the well installation.

When in transmit mode, the downhole transceiver module 41 has a high power consumption which is necessary to apply large enough signals to the tubing portion 21 and hence casing 11 so that they may reach the surface transceiver 31.

In previous systems used by the Applicants, such power has been provided for, in general terms, by a large array of batteries. In the present embodiment, whilst some power may be provided to the downhole communication and control unit 4 by batteries, the majority of power required for signalling is provided by another source.

Within the tubing portion 21, two fluid receiving chambers 21*a* and 21*b* are provided. The first and second fluid receiving chambers 21*a*, 21*b* are separated by a dividing wall 24. An opening 24*a* is provided in this dividing wall 24 and this opening 24*a* acts as a fluid communication path between the first chamber 21*a* and the second chamber 21*b*. A valve 25 is provided in the opening 24*a* to control the flow of fluid from the first chamber 21*a* to the second chamber 21*b*. In particular, if the valve 25 is closed, flow of fluid from the first chamber 21 to the second chamber 21*b* is, to all intents and purposes, prevented.

A turbine generator 26 is provided in the region of the opening 24*a* such that when fluid flows from the first chamber 21*a* into the second chamber 21*b* this causes the turbine generator to operate thus generating electricity. The turbine generator 26 is electrically connected to the communications and control unit 4 and as such electricity generated by the turbine generator 26 may be used by the communications and control unit 4. In particular, this electrical power may be used in transmitting signals from the downhole tool 2 towards the surface.

In the present embodiment, the first fluid receiving chamber 21*a* is filled with oil or water and the second fluid receiving chamber 21*b* is filled with air. The second fluid receiving chamber is sealed against the ingress or egress of the fluid other than via the opening 24*a*. Similarly, the first fluid receiving chamber 21*a* is sealed against the ingress or egress of fluid other than via the opening 24*a*. However, whilst the second fluid receiving chamber 21*b* has a simple blank end such that it has a constant volume, the first fluid receiving chamber 21*a* is sealed, at its end remote from the dividing wall 24, by a movable piston 27. This moveable piston 27 is movable axially within the tubing portion 21 and has a sealed sliding fit therewith. The piston 27 is generally cylindrical so as to match the internal shape of the tubular portion 21 and is provided with O-ring seals.

In the present embodiment, the tool 2 and hence the tubing portion 21 has an overall length of approximately 200 meters. The dividing wall 24 is provided approximately mid-way along this length. Thus, the second fluid receiving portion 21*b* has an effective length of in the order of 100 meters. Furthermore, when the piston 27 is slid so as to maximise the volume of the first fluid receiving chamber 21*a*, this has a length of approximately 90 meters.

The face of the piston 27 which faces externally, that is away from the dividing wall 24, is exposed to the surroundings. In the present embodiment the piston 27 is exposed to the surroundings by virtue of apertures A (one of which is shown in the Figures) in the tubing portion 21, which allow fluid into the tubing portion 21 on the external side of the piston 27. Thus, when the downhole tool 2 is disposed in situ downhole, this external face 27 is exposed to the ambient pressure present in the product in the well. Of course this is typically a high pressure environment (say 5000 psi).

Whilst the valve 25 is kept closed, the piston 27 will remain generally static. However, if the valve 25 is opened allowing the oil or water in the first fluid receiving chamber 21 to flow into the second fluid receiving chamber 21*b*, then the pressure acting on the piston 27 can cause the piston 27 to move and thus drive this flow of fluid from the first fluid receiving chamber 21*a* into the second fluid receiving chamber 21*b*.

Of course, whilst this flow occurs, this will drive the turbine causing the turbine generator 26 to generate electricity which is fed to the communications and control unit 4.

As this process occurs, the air in the second fluid receiving chamber 21*b* will be compressed. However, this should cause no difficulties as the components used to make the chambers 21*a*, 21*b*, in particular the tubing portion 21 and a valve 25 can be components typically used in the oil and gas industry and well able to operate under extreme pressures. Furthermore, even though the pressure in the air of the second chamber 21*b* may increase by a factor of ten if the piston is allowed to travel along its whole length (i.e. driving 90 meters worth of oil/water into 100 meters of available space in the second chamber 21*b*), this will not prevent the system working.

For the present embodiment to function the pressure of the air in the second chamber 21*b* needs to be below the ambient pressure downhole at least in an initial state.

As the tool 2 will generally be assembled at the surface, at that stage, the air in the second fluid receiving chamber 21*b* can conveniently be at one bar (15 psi). This means that if the piston 27 moves to its maximum extent downhole, this will drive the air pressure up to say, 10 bar (150 psi). However, this pressure is still small compared with the available downhole pressure for driving the piston 27—say 5000 psi.

Of course, the turbine generator 26, the valve 25, and the size of the opening 24*a* may be chosen with the aim of generating a suitable amount of electricity at a suitable rate.

In alternatives some form of charge storage means, be these for example, rechargeable cells, or capacitors may be provided in the tool 2 to store excess electricity generated during the generation process or to build up power over time for a transmission.

The control module 42 is arranged to control the operation of the valve 25 so that insofar as possible, power is only generated by the turbine 26 where it is required by the communications and control unit 4. Thus, the control module 42 can be arranged to open the valve 25 to cause the generation of electricity when signals are to be transmitted. In alternatives the control module 42 can be arranged to open the valve 25 to cause the generation of electricity under predetermined conditions, for example at set times.

At positions between the packer 22 and the conductive centraliser 23 the tubing portion 21 is insulated from the casing 11 to maximise the injection of signals into the casing 11 and extraction of signals from the casing 11. Such insulation may be provided by the provision of an insulating layer on the tubing 21 or the use of insulated centralisers 23*a*. The length of tubing 21 may have two metallic portions which are insulated from one another by an insulation joint to again help in the injection and extraction of signals. The transceiver 41 can then be connected across the insulation joint.

Of course, the size of the tool described, i.e. using an overall length of approximately 200 meters, is a matter of design choice. If there are lower power requirements or power is required over a shorter time, a smaller unit might be produced. Conversely, if there are larger power requirements or power is required over a longer time, then a longer unit might be provided.

With the embodiment in the present form it is most suited for use in an abandoned well as the tool 2 itself is large and occupies the whole diameter of what would otherwise be drill stem or production tubing.

In alternative implementations, it would be possible to have different sized or shaped units which would perhaps be more suitable for use in non-abandoned wells. Such a unit might be locatable in the annulus between two sets of tubing in a well. Such a unit might be arranged as a mandrel tool.

Whilst in the present embodiment one of the fluid receiving chambers 21*a* is filled with a liquid and the other fluid receiving chamber 21*b* is filled with gas and this the preferred arrangement, this should not be considered as essential.

Furthermore, whilst in the present embodiment a piston 27 is provided to control the volume of the first chamber 21*a*, again this should not be considered essential. In one particular, but less preferred, alternative it might be possible to dispense with the piston 27 altogether and just expose the first chamber 21*a* directly to the ambient pressure—that is to the product, and allow the product flow through the turbine generator and into the second chamber 21*b*.

Of course whilst the present embodiment is described in terms of a signalling system, similar power generation apparatus may be used to generate electrical power for different uses.

FIG. 3 shows an alternative downhole tool 2' which is similar to that described above in relation to FIG. 2. Many of the parts and aspects of the operation of this downhole tool are the same as that described above in relation to FIG. 2. The same reference numerals are used to denote the common parts between this downhole tool 2' and that described above 2 and detailed description of these common parts is omitted for the sake of brevity. Furthermore, some of the detail of the downhole tool 2' which is the same as that shown above in FIG. 2 is also omitted from FIG. 3 for the sake of simplicity. Thus, the drawing of the alternative downhole tool 2' shown in FIG. 3 and the following description concentrate on the differences between these two tools 2, 2' rather than the similarities. Where some aspect of the tool 2' is not shown in FIG. 3 or described in reference to FIG. 3, it should be assumed that the corresponding features are the same as in the tool 2 of FIG. 2.

Here again, there are first and second chambers 21*a*, 21*b* defined within a tubing portion 21 and again a turbine generator 26 is provided between these two fluid receiving chambers 21*a*, 21*b* such that flow of fluid, i.e. oil or water, from the first fluid receiving chamber 21*a* into the second fluid receiving chamber 21*b* will cause the generation of electricity. The control and operation of this part of the tool is the same as that tool shown in FIG. 2 and described above. Here, however, rather than the external face of the piston 27 being directly exposed to the ambient pressure as is in the case of the tool shown in FIG. 2, a third fluid receiving chamber 21*c* is provided.

This third fluid receiving chamber 21*c* has one end defined by the piston 27 which also defines the end of the first chamber 21*a* and another end defined by a second piston 28. Again this second piston is arranged to slide axially within the tubing portion 21 and to seal therewith. Thus the third fluid receiving portion 21*c* is sealed against the ingress or egress of fluid.

In the present downhole tool 2', the third receiving chamber 21*c* is filled with a gas, for example air, at the point of installation. On installation, the second piston 28 is located in the position shown in dotted lines in FIG. 3 and marked 28'. At this point in time, of course, the third fluid receiving chamber 21*c* is larger and encompasses that region of the tubing marked 21*c'*.

When the tool 2' is assembled and is at the surface, the second piston 28' is in this position. However, when the tool 2 is first installed downhole, the ambient pressure is allowed to act on the second piston 28 by virtue of the fluid in the well, i.e. product, flowing in through apertures A (only one of which is shown in FIG. 3) into the tubing so as to act on the external surface of the second piston 28. This causes the second piston to move from the position shown in the dotted lines 28' to the position shown in solid lines 28. In doing so, the volume of the third fluid receiving chamber 21*c* is reduced and the gas carried within that volume is compressed. At this point the second piston 28 is locked in position relative to the tubing 21 via a locking arrangement 28*a*. Thus there is now a high pressure gas (or possibly, strictly, a super-critical fluid—as explained further below) in the third receiving chamber 21*c* due to the pressurisation caused by the application of the ambient pressure.

This high pressure gas 21*c* may be used to drive the first piston 27 when this is desired in the same way as described above with reference to FIGS. 1 and 2. In particular, when it is desired to generate electricity, the valve 25 may be opened causing the turbine generator 26 to be operated by the flow of fluid from the first chamber 21*a* to the second chamber 21*b*. In this instance it is the pressurised gas in the third chamber 21*c* which is being used (indirectly) to power the generator 26. Of course the origin of the pressurised gas in the third fluid receiving chamber 21*c* is still ultimately the ambient pressure, as it was this which was used to charge the third fluid receiving chamber 21*c* when the tool 2 was installed.

The advantage of using this alternative tool 2' is that the effect of, as one might say, taking pressure from the fluid in the well, i.e. product, occurs once and only once when the tool is first initiated. This avoids the situation where there can be a large number of separate operations of the tool over time each of which could change the pressure of the product in the region of the tool 2' at least transiently. This, in turn, is important because one of the things which the tool 2' is most likely to be used for is taking pressure measurements of the product in the well. Thus, in at least some circumstances it might be the case that continued extraction of energy from the fluid by allowing the fluid to operate on the piston 27 of the device shown in FIG. 2, could affect the measurement results. This would be particularly the case were pressure measurements to be taken at around the time that energy was extracted from the product. That is to say, if the device of FIG. 2 were used to extract energy from the well and then use this to immediately make a pressure measurement, the very act of allowing the piston 27 to move to extract energy from the pressure could cause a change in the localised pressure in the well which in turn could skew the pressure measurement results.

In the alternative tool as shown in FIG. 3, this potential problem is eliminated by once and only once using pressure from the local fluid to drive the second piston 28 to its locked position as shown in solid lines in FIG. 3.

It has been realised by the Applicants that there is a potential pitfall with the type of system shown in and described with reference to FIG. 3. Whilst it is an advantage that the fluid in the well is disturbed only once, there is a disadvantage in trying to store energy in the pressurised gas in the third chamber 21*c*.

This is two fold. First, as would be immediately expected, there is a disadvantage in that the pressure in the third chamber 21*c* will fall as the fluid in the first chamber 21*a* is driven through the turbine generator 26 and the first piston 27 moved increasing the volume of the third chamber 21*c*. However, there is also the issue that the stored gas will enter its "supercritical" phase (or, if not this, become a liquid) long before the pressure in the third chamber 21*c* reaches normal well pressure (say 5000 psi). This means that the energy stored in the pressurised gas in the third chamber 21*c* is dramatically reduced. After the stored gas enters its supercritical phase at say 500 psi it becomes almost incompressible (as it would also do if it became a liquid) and from that point onward the volume of the third chamber 21*c* will reduce only slightly—the second piston 28 will almost stop moving—and very little additional energy will be stored. Then as the first piston 27 is allowed to move as energy is being extracted, the pressure in the third chamber will very quickly drop to the critical pressure—say 500 psi. Only after this will the stored gas begin to behave "normally" again.

Both of these effects limit what energy can be stored in a given size tool—ie given size third chamber 21*c*.

Two alternative apparatus and techniques are described below which aim at alleviating these problems.

FIG. 4 schematically shows a second alternative downhole tool 2" which can be used in these techniques. The tool 2" used in these two alternative techniques is similar to that described with respect to FIGS. 2 and 3 above. Thus, a detailed description of its structure and operation will be omitted and the same reference numerals are used to indicate the corresponding parts. The second alternative downhole tool 2" has most in common with the alternative downhole tool 2' shown in FIG. 3. The difference between these two tools 2', 2" is as follows. The moveable and lockable piston 28 of the first alternative downhole tool 2' is replaced by a stationery blanking member 29 (which in practice could be constituted by the same component as the moveable lockable piston 28 whilst locked in place), which includes a non-return valve NRV which is arranged to allow fluid, in particular gas, in the region of the tool to enter into the third chamber 21*c* having passed through apertures A (only one of which is shown in the drawing) in the tubular wall of the tool. Further, as a non-return valve, the non-return valve NRV is also arranged to prevent fluid from escaping from the third chamber 21*c* once it has been introduced. The non-return valve NRV may be controllable so as to be operable at chosen times and disabled (i.e. not able to allow the flow of fluid through it) at other times. The remainder of the structure of the second alternative tool 2" is basically the same as that of the first alternative tool 2' and the functioning is very similar.

Again, pressurised gas in the third chamber 21*c* can be used to move the piston 27, thus driving fluid through the turbine generator 26 to generate electricity under control of the valve 25. Here however, the third chamber 21*c* is charged directly with pressurised gas rather than being pressurised by movement of a second piston as is the case in the first alternative downhole tool shown in FIG. 3.

There are two distinct mechanisms by which the third chamber 21*c* in the second alternative downhole 2" may be charged with gas.

When the well in which the tool is situated is a gas well then, as a one time operation the non-return valve NRV may be opened to allow gas in the region of the tool 2" to enter the third chamber 21*c* once the tool 2" is situated in its intended downhole location (or of course any other suitable location). This then achieves the advantage of only disturbing the fluid in the well once, and also allows the storing of a larger volume of highly pressurised gas within a given length of tool than is the case in the first alternative downhole tool 2' where the gas in the third chamber 21*c* is introduced in a non pressurised state and then pressurised by movement of the moveable piston 28.

However in a situation where the second alternative downhole tool 2" is to be used in a well in which no pressurised gas is available (that is an exclusively oil well), a different technique is required to charge the third chamber 21*c* with gas. In such a situation the third chamber 21*c* may be charged with gas whilst the tool is relatively near to the surface in the well. In particular, the third chamber 21*c* may be charged with gas making use of existing lubricator well technology in which a pressurised gas may be introduced into the well in the region of the well head. In the present case, the gas is chosen to be of a suitable type and pressure for use in operating the tool 2". The gas injected into the well passes through the non-return valve NRV and into the third chamber 21*c*, whilst the tool 2" is in the region of the well head or wherever else lubricator gas can be injected. Once charged, the tool 2" can be moved to its intended downhole location.

It should be noted that in each of the above techniques for using the second alternative tool 2", the key to obtaining more useful energy from a given size of tool is that a larger volume of high pressure gas (or perhaps strictly supercritical fluid) may be stored in a given length of tool. It will still be the case that if the gas is at a very high pressure, for example 5000 psi it will be in a supercritical phase and thus nearly incompressible. It will still lose its pressure very quickly as the volume in which it is contained is increased. However this effect, as mentioned above, only occurs until the gas returns to a normal gas phase. At that point the energy stored in the gas is proportional to the volume of gas held in the third chamber 21*c*. By directly charging the third chamber 21*c* with high pressure gas whilst at a maximum size allowed by the tool, more energy will be stored than if the third chamber 21*c* is charged with low pressure gas whilst at maximum size and this gas is then pressurised by reducing the volume of the third chamber 21*c* using ambient pressure as in the technique described above in relation to FIG. 3.

Whilst not explicitly mentioned above it will be realised that the valve 25 mentioned above in each tool 2, 2', 2" may be used not only to control when electricity is generated, but also, for example by use of feedback, how much electricity is generated in the above systems. The valve may be opened further if output drops too low, eg due to reduced pressure, or moved towards being closed if output is too high.

The invention claimed is:

1. Downhole electrical power generation apparatus comprising first and second fluid receiving chambers separated by a dividing wall, wherein an opening in the dividing wall acts as a fluid communication path for allowing flow of fluid from the first chamber via the fluid communication path to the second chamber, and wherein a turbine generator and valve provided to control fluid flow from the first fluid receiving chamber to the second fluid receiving chamber are disposed in the region of the opening so that, upon opening the valve, fluid flowing from the first chamber via the fluid communication path to the second chamber operates the turbine generator to generate electrical power, the apparatus further comprising a third fluid receiving chamber, a piston which is moveable to reduce the volume of the first chamber for driving fluid from the first chamber into the second chamber and a second piston which is moveable under action of ambient pressure to reduce the volume of the third fluid receiving chamber and is lockable via a locking arrangement against such movement.

2. Downhole electrical power generation apparatus according to claim 1 in which the second chamber is sealed against the ingress of fluid except for fluid received from the first chamber.

3. Downhole electrical power generation apparatus according to claim 2 in which the second chamber is sealed against the ingress of fluid except via the fluid communication path from the first chamber.

4. Downhole electrical power generation apparatus according to claim 1 in which the first chamber is sealed against the egress of fluid except for fluid supplied towards the second chamber.

5. Downhole electrical power generation apparatus according to claim 4 in which the first chamber is sealed against the egress of fluid except via the fluid communication path to the second chamber.

6. Downhole electrical power generation apparatus according to claim 1 in which the third fluid receiving chamber is arranged to store a pressurized gas.

7. Downhole electrical power generation apparatus according to claim 1 which comprises a non-return valve for allowing ingress of fluid into the third fluid receiving chamber from the exterior of the apparatus.

8. Downhole electrical power generation apparatus according to claim 1 in which the chambers and pistons are arranged with the second piston exposed to ambient pressure and being disposed at one end of the third chamber, the first piston disposed between the third chamber and the first chamber, and the first chamber being disposed between the third chamber and the second chamber.

9. Downhole electrical power generation apparatus according to claim 1 which comprises a controller for controlling flow of fluid from the first chamber to the second chamber via the fluid communication path.

10. Downhole electrical power generation apparatus according to claim 9 in which the controller is arranged to allow flow of fluid via the fluid communication path to generate electricity when in receipt of a signal indicating that power is required.

11. A downhole communication system comprising:

communication apparatus comprising at least one of a transmitter and a receiver; and downhole electrical power generation apparatus comprising first and second fluid receiving chambers separated by a dividing wall, wherein an opening in the dividing wall acts as a fluid communication path for allowing flow of fluid from the first chamber via the fluid communication path to the second chamber, and wherein a turbine generator and valve provided to control fluid flow from the first fluid receiving chamber to the second fluid receiving chamber are disposed in the region of the opening so that, upon opening the valve, fluid flowing from the first chamber via the fluid communication path to the second chamber operates the turbine generator to generate electrical power for supply to the communication apparatus, the downhole electrical power generation apparatus further comprising a third fluid receiving chamber, a piston which is moveable to reduce the volume of the first chamber for driving fluid from the first chamber into the second chamber and a second piston which is moveable under action of ambient pressure to reduce the volume of the third fluid receiving chamber and is lockable via a locking arrangement against such movement.

12. A downhole communication system according to claim 11 in which the communication apparatus comprises a control unit which is arranged to send a signal, indicating that power is required, to the downhole electrical power generation apparatus at predetermined times and/or under predetermined conditions.

13. A well installation comprising downhole metallic structure and, disposed within the metallic structure, downhole electrical power generation apparatus according to claim 1.

14. A method of downhole electrical power generation using downhole electrical power generation apparatus comprising first and second fluid receiving chambers separated by a dividing wall, wherein an opening in the dividing wall acts as a fluid communication path for allowing flow of fluid from the first chamber via the fluid communication path to the second chamber, and wherein a turbine generator and valve provided to control fluid flow from the first fluid receiving chamber to the second fluid receiving chamber are disposed in the region of the opening so that, upon opening the valve, fluid flowing from the first chamber via the fluid communication path to the second chamber operates the turbine generator to generate electrical power, the apparatus further comprising a third fluid receiving chamber, a piston which is moveable to reduce the volume of the first chamber for driving fluid from the first chamber into the second chamber and a second piston which is moveable under action of ambient pressure to reduce the volume of the third fluid receiving chamber and is lockable via a locking arrangement against such movement, the method comprising a step of pressurizing the third fluid receiving chamber using ambient pressure and in turn using the pressure in the third fluid receiving chamber to cause the flow of fluid from the first fluid receiving chamber to the second fluid receiving chamber.

15. Downhole electrical power generation apparatus comprising first and second fluid receiving chambers separated by a dividing wall, wherein an opening in the dividing wall acts as a fluid communication path for allowing flow of fluid from the first chamber via the fluid communication path to the second chamber, and wherein a turbine generator and valve provided to control fluid flow from the first fluid receiving chamber to the second fluid receiving chamber are disposed in the region of the opening so that, upon opening the valve, fluid flowing from the first chamber via the fluid communication path to the second chamber operates the turbine generator to generate electrical power, the apparatus further comprising a piston which is moveable to reduce the volume of the first chamber for driving fluid from the first chamber into the second chamber, a third fluid receiving chamber, and a non-return valve for allowing ingress of fluid into the third fluid receiving chamber from the exterior of the apparatus, wherein the third fluid receiving chamber has one end defined by the piston and is arranged to store a pressurized gas.

16. Downhole electrical power generation apparatus according to claim 15 in which the second chamber is sealed against the ingress of fluid except for fluid received from the first chamber.

17. Downhole electrical power generation apparatus according to claim 16 in which the second chamber is sealed against the ingress of fluid except via the fluid communication path from the first chamber.

18. Downhole electrical power generation apparatus according to claim 15 in which the first chamber is sealed against the egress of fluid except for fluid supplied towards the second chamber.

19. Downhole electrical power generation apparatus according to claim 18 in which the first chamber is sealed against the egress of fluid except via the fluid communication path to the second chamber.

20. Downhole electrical power generation apparatus according to claim 15 which comprises a controller for controlling flow of fluid from the first chamber to the second chamber via the fluid communication path.

21. Downhole electrical power generation apparatus according to claim 20 in which the controller is arranged to allow flow of fluid via the fluid communication path to generate electricity when in receipt of a signal indicating that power is required.

22. A downhole communication system comprising:

communication apparatus comprising at least one of a transmitter and a receiver; and downhole electrical power generation apparatus comprising first and second fluid receiving chambers separated by a dividing wall, wherein an opening in the dividing wall acts as a fluid communication path for allowing flow of fluid from the first chamber via the fluid communication path to the second chamber, and wherein a turbine generator and valve provided to control fluid flow from the first fluid receiving chamber to the second fluid receiving chamber are disposed in the region of the opening so that, upon opening the valve, fluid flowing from the first chamber via the fluid communication path to the second chamber operates the turbine generator to generate electrical power for supply to the communication apparatus, the downhole electrical power generation apparatus further comprising a piston which is moveable to reduce the volume of the first chamber for driving fluid from the first chamber into the second chamber, a third fluid receiving chamber, and a non-return valve for allowing ingress of fluid into the third fluid receiving chamber from the exterior of the apparatus, wherein the third fluid receiving chamber has one end defined by the piston and is arranged to store a pressurized gas.

23. A downhole communication system according to claim 22 in which the communication apparatus comprises a control unit which is arranged to send a signal, indicating that power is required, to the downhole electrical power generation apparatus at predetermined times and/or under predetermined conditions.

24. A well installation comprising downhole metallic structure and, disposed within the metallic structure, downhole electrical power generation apparatus according to claim 15.

25. A well installation according to claim 24 comprising lubricator technology for injecting pressurized gas into the well for charging the third fluid receiving chamber.

26. A method of downhole electrical power generation comprising the steps of using energy stored in a stored pressurized gas to cause flow of fluid from a first fluid receiving chamber via a fluid communication path to a second fluid receiving chamber, the first fluid receiving chamber and second fluid receiving chamber separated by a dividing wall, wherein an opening in the dividing wall acts as the fluid communication path, and upon opening a valve disposed in the region of the opening, flow of fluid from the first chamber to the second chamber is used to operate a turbine generator disposed also in the region of the opening to generate electrical power, wherein the stored pressurized gas is stored in a third fluid receiving chamber and the method comprises the step of supplying pressurized gas into the third fluid receiving chamber.

27. A method according to claim 26 wherein the gas is injected into the well using lubricator technology and used to charge the third fluid receiving chamber.

28. A method according to claim 27 in which the third fluid receiving chamber is charged whilst in the region of the well head and subsequently a tool including the third fluid receiving chamber is moved further downhole.

29. A method according to claim 26 in which fluid is supplied into the third fluid receiving chamber via a non-return valve.

* * * * *